United States Patent [19]

Malik et al.

[11] Patent Number: 4,685,478

[45] Date of Patent: Aug. 11, 1987

[54] THERMOPHILIC DENITRIFICATION OF TOBACCO

[75] Inventors: Vedpal S. Malik; Bernard A. Semp; Hernan G. Bravo; Daniel M. Teng, all of Richmond, Va.

[73] Assignee: Philip Morris Incorporated, New York, N.Y.

[21] Appl. No.: 307,602

[22] Filed: Oct. 1, 1981

[51] Int. Cl.[4] ..... A24B 15/20; A24B 15/24

[52] U.S. Cl. ..... 131/297; 131/308

[58] Field of Search ..... 131/247, 248, 308, 297, 131/256; 210/601, 603, 605; 435/172, 262, 267

[56] References Cited

U.S. PATENT DOCUMENTS

| | | |
|---|---|---|
| 2,000,855 | 5/1935 | Lippmann et al. . |
| 2,317,792 | 4/1943 | Moser . |
| 3,616,801 | 11/1971 | Hind . |
| 3,747,608 | 7/1973 | Gravely et al. . |
| 3,829,377 | 8/1974 | Hashimoato . |
| 3,847,164 | 11/1974 | Mattina et al. . |
| 4,037,609 | 7/1977 | Newton et al. . |
| 4,131,118 | 12/1978 | Gellatly et al. . |
| 4,225,430 | 9/1980 | Bosman . |
| 4,253,929 | 3/1981 | Keritsis . |
| 4,301,817 | 11/1981 | Keritsis . |
| 4,308,877 | 1/1982 | Mattina . |

FOREIGN PATENT DOCUMENTS

| | | |
|---|---|---|
| 1081076 | 7/1980 | Canada . |
| 0005082 | 10/1979 | European Pat. Off. . |
| P31007155 | 7/1982 | Fed. Rep. of Germany . |
| 7349999 | 7/1973 | Japan . |
| 2014031 | 8/1979 | United Kingdom . |
| 1557253 | 12/1979 | United Kingdom . |
| 2023995 | 1/1980 | United Kingdom . |
| 2028628A | 3/1980 | United Kingdom ..... 131/308 |
| 1585023 | 2/1981 | United Kingdom . |
| 1585024 | 2/1981 | United Kingdom . |

OTHER PUBLICATIONS

B. Dumery and J. P. Albo, "Participation of Microorganisms in the Fermentation of Dark Tobacco Submitted to a Pre-Storage Thermic Treatment Storage Type of Process", *A. du Tabac,* Sect. 2-16, Bergerac, S.E-.I.T.A. (1979-80).

C. F. English et al., "Isolation of Thermophiles from Broadleaf Tobacco and Effect of Pure Culture Inoculation on Cigar Aroma and Mildness", *Applied Microbiol.,* 15, pp. 117-119 (Jan. 1967).

D. D. Focht, "The Effect of Temperature, pH and Aeration on the Production of Nitrous Oxide and Gaseous Nitrogen—A Zero-Order Kinetic Model", *Soil Science,* 118, pp. 173-179 (1974).

W. O. Atkinson et al., *Ky. Arg. Exp. Sta. Lexington Ann. Report,* 86, p. 22 (1973).

J. M. Bremner and K. Shaw, "Denitrification in Soil II. Factors Affecting Denitrification", *J. Agricultural Science,* 51, pp. 40-52 (1958).

M. Henze Christensen and P. Harremoes, "Biological Denitrication of Sewage: A Literature Review", Prog. Wat. Tech., 8, pp. 509-555 (1977).

S. A. Ghabrial, "Studies on the Microflora of Air--Cured Burley Tobacco", *Tobacco Science,* pp. 80-82 (1976).

A. Koiwai et al, "Fermentation of Tobacco, II. Variations in Fermentation Procedure and Its Effect on Total Particulate Matter and Benzo(a)pyrene" *Tobacco Science,* 15, pp. 41-43 (1971).

H. Nommik, "Investigations on Denitrification in Soil", *Acta Agriculture Scandinavica,* 6, pp. 195-228 (1956).

H. E. Reiling et al., "Calometric Studies of the Anaerobic Respiration of a Thermophilic Bacillus Species", Inst. Mol. Biol., Biophys. Swiss Fed. Inst. Technol, CH-8093, Zurich Switzerland and *J. Calorim. Anal. Therm.,* 11, pp. 3-14-1-3-14-18 (1980) [Chemical Abstracts, 95:93615c, p. 298 (Sep. 1981).

P. A. Nielsen, "Physiological Properties of Nitrate-Reducing Micrococi Isolated from Tobacco Leaves Dissertation, Columbia University, 1960.

*Primary Examiner*—V. Millin
*Assistant Examiner*—H. Macey
*Attorney, Agent, or Firm*—Arthur I. Palmer, Jr.; James F. Haley, Jr.; Margaret A. Pierri

[57] ABSTRACT

High temperature processes and thermophilic organisms for use in those processes for reducing the levels of certain nitrogen-containing compounds in tobacco materials. Tobacco materials are contacted with at least one thermophilic organism characterized by an anaerobic, dissimilatory, metabolic pathway for denitrification of tobacco materials under anaerobic and high temperature conditions that promote such metabolism. Tobacco materials treated in accordance with these high temperature processes and thermophilic organisms, when incorporated into a smoking product, deliver a significantly reduced amount of oxide of nitrogen in smoke. Moreover, such tobacco materials also afford the product of other tobacco products having lower amounts of nitrates and other nitrogen-containing compounds.

12 Claims, No Drawings

THERMOPHILIC DENITRIFICATION OF TOBACCO

TECHNICAL FIELD OF THE INVENTION

This invention relates to the denitrification of tobacco materials via dissimilatory metabolism. More particularly, it relates to high temperature processes and thermophilic microorganisms useful in those processes for reducing the levels of certain nitrogen-containing compounds present in tobacoo materials. The high temperature processes and thermophilic microorganisms of this invention reduce the levels of nitrates and other nitrogen-containing compounds in tobacco materials via an anaerobic dissimilatory metabolic pathway.

BACKGROUND ART

It is generally recognized that reduced delivery of oxides of nitrogen in the smoke of tobacco products is desirable. Therefore, a number of methods have been developed to reduce the levels of nitrogen oxide precursors, such as nitrates, in smoking products. Those prior art methods are of three main types—ion exchange, crystallization and microbiological.

Ion exchange-based methods for reducing the levels of nitrate in tobacco materials are described, for example, in U.S. Pat. Nos. 3,616,801, 3,847,164 and 4,253,929. These methods, such as ion exchange, ion retardation and electrodialysis, while perhaps feasible on a small scale, are both expensive and impractical on a larger scale. In addition, regeneration of the required resins and membranes, isolation and disposal of the nitrogen-containing by-products and cost and disposal of the spent resins and membranes add to the cost of the processes.

Crystallization-based methods for reducing nitrate concentration in tobacco materials are described, for example, in U.S. Pat. No. 4,131,118. These methods are usable in large scale processes and permit the rapid isolation of the nitrogen-containing by-products. However, these methods are not only limited by the necessity to dispose of the by-product, they are limited by the level of nitrate-nitrogen reduction that can be obtained in them. For example, tobacco extracts after treatment by these processes usually contain between about 0.4% to 0.45% (4000–4500 ppm) nitrate-nitrogen. Further reductions in the nitrate-nitrogen concentration of these extracts would plainly be advantageous, if they could be obtained in a cost effective manner.

A wide variety of microbial processes and microorganisms useful in those processes have also been proposed for reducing the levels of certain nitrogen-containing compounds in tobacco materials. These processes and organisms, which may be either aerobic or anaerobic, make use of both dissimilatory and assimilatory pathways to metabolize the nitrogen-containing compounds. These processes and organisms, for example, include those of U.S. Pat. No. 3,747,608, British patent specification No. 1,557,253 (stated to be based on U.S. application Ser. No. 883,449, filed Mar. 6, 1978, now U.S. Pat. No. 4,308,877), UK patent specification Nos. 2,014,031 (based on Luxembourg application No. 79039, filed Feb. 9, 1978, now Luxembourg patent No. 79039), 2,023,995 (stated to be based on U.S. application Ser. No. 916,322, filed June 15, 1978) and 2,028,628 (stated to be based on U.S. application Ser. No. 916,323, filed June 15, 1978), Canadian patent No. 1,081,076 (based on Luxembourg application No. 77272, filed May 6, 1977, and Luxembourg patent No. 77272), now Luxembourg application No. 77872, filed July 29, 1977, now Luxembourg patent No. 77872), European patent No. 5,082 (based on U.S. application Ser. No. 900,044, filed Apr. 25, 1978) and West German patent application No. P3100715.5, filed Jan. 13, 1981 (Offenlegungsschriften No. DE 3100715).

While some of these processes make use of bacteria that belong to the indigenous microflora of tobacco, each employs only non-thermophilic microorganisms as the active microbial agent. Each also employs only low temperature fermentation conditions—5°–40° C. For example, British patent specification No. 1,557,253 employs 5°–35° C. Canadian patent No. 1,081,076—25°–35° C., UK patent specification No. 2,014,031—25°–35° C., UK patent application specification No. 2,023,995—20°–40° C., UK patent application specification No. 2,028,628—5°–37° C., European patent No. 5,082—30°–40° C., West German patent application (Offenlegungsschriften No. DE 3100715).—30° C. and U.S. Pat. No. 3,747,608—24°–40° C.

Most of these processes also require that the tobacco materials be terminally sterilized (e.g., 121° C. for 15 min at 15 psig) before contact with the microorganisms and that the fermentation be conducted under substantially aseptic conditions. The various anaerobic processes also usually require sparging of the fermentation broth with inert gases or other treatments to limit the oxygen concentration.

A number of these processes also require various additives to be incorporated into the fermentation broths or to supplement the tobacco material isolated from those broths after fermentation. For example, British patent specification No. 1,557,253 requires various organic compounds to be added to the tobacco materials, Canadian patent No. 1,081,076 and UK patent application No. 2,014,031A require D-glucose and other additives and West German patent application No. P3100715.5 requires that sugars be added to the broth. Plainly, any requirement for such additives increases the cost of such processes and may result in non-tobacco compounds being incorporated into the tobacco materials.

Other microbial-based processes for treating tobacco are also known in the art. For example, U.S. Pat. Nos. 2,000,855, 3,747,608 and 4,037,609 purport to describe microbial processes and microorganisms for degrading nicotine that may be present in tobacco. These processes, although again perhaps making use of bacteria that belong to the indigenous microflora of tobacco, are also non-thermophilic and employ low temperature fermentation conditions. E.g., 24°–40° C. (U.S. Pat. No. 3,747,608), 20°–45° C. (U.S. Pat. No. 4,037,609) and 30°–40° C. (U.S. Pat. No. 2,000,855).

In addition, Japanese patent No. 73 49,999 (C.A. 79:123942x), S. A. Ghabrial, "Studies On The Microflora Of Air-Cured Burley Tobacco", *Tobacco Science*, pp. 80–82 (1976), W. O. Atkinson et al., *Ky. Agr. Exp. Sta. Lexington Ann. Report*, 86, p. 22 (1973), A. Koiwai et al., *Tob. Sci*, 15, pp. 41–3 (1971) and U.S. Pat. No. 2,317,792 purport to describe other microbial-based fermentation and curing processes for tobacco. Again, each of these processes employs non-thermophilic organisms and low temperature fermentation conditions, e.g., 25°–50° C. (Japanese patent No. 73 49,999), 30°–35° C. (S. A. Ghabrial) and 30°–40° C. (A. Koiwai et al.).

Biological processes for reducing the concentration of nitrogen-containing compounds in waste water are also known in the art. These include, for example, U.S. Pat. Nos. 3,829,377 and 4,225,430. Again, they employ non-thermophilic microorganisms and low temperature conditions, e.g., 10°-50° C. (U.S. Pat. No. 3,829,377). Again, they require a carbon source to be added to the waste water, e.g., molasses (U.S. Pat. No. 4,225,430) and $C_1$ to $C_3$ hydrocarbons (U.S. Pat. No. 3,829,377).

Finally, the growth of thermophilic microorganisms on "sweating" tobacco is known to occur. However, such organisms have not been employed to reduce the content of nitrogen-containing compounds in tobacco. Rather, they have only been described to affect the aroma and mildness of cigar tobacco. Such processes include, for example, those of C. F. English et al., "Isolation of Thermophiles From Broadleaf Tobacco And Effect Of Pure Culture Inoculation On Cigar Aroma And Mildness", *Applied Microbiol.*, 15, pp. 117-19 (January 1967) and B. Dumery and J. P. Albo, "Participation of Microorganisims In The Fermentation Of Dark Tobacco Submitted To A "Pre-Storage-Thermic Treatment Storage" Type Of Process", *A du Tabac*, Sect. 2-16, Bergerac, S.E.I.T.A. (1979-80).

Microorganisms are also known to denitrify soil and sewage. Such processes are described, for example, in M. Henze Christensen and P. Harremoës, "Biological Denitrification of Sewage: A Literature Review", *Prog. Wat. Tech.*, 8, pp. 509-55 (1977); D. D. Focht, "The Effect Of Temperature, pH And Aeration On The Production Of Nitrous Oxide And Gaseous Nitrogen—A Zero-Order Kinetic Model," *Soil Science*, 118, pp. 173-79 (1974); J. M. Bremner and K. Shaw, "Denitrification In Soil II. Factors Affecting Denitrification", *J. Agricultural Science*, 51, pp. 40-52 (1958); and H. Nommik, "Investigations On Denitrification In Soil", *Acta Agriculture Scandinavica*, 6, pp. 195-228 (1956). None of these references discloses the use of thermophilic organisms in denitrification. Moreover, the ones that report that the rate of nitrate reduction increases with increasing fermentation temperatures attribute the observed rate increase to the standard temperature effect on a biochemical reaction, not the activation and growth of a new class of microorganisms. And, none suggests such temperature-dependent rate increases would be observed in tobacco fermentation.

Therefore, none of these prior processes makes use of high temperature processes and thermophilic microorgansims to reduce the content of nitrogen-containing compounds in tobacco materials. Neither do any of these prior processes suggest that these nitrogen-containing compounds of tobacco materials could be metabolized at high temperatures via dissimilatory pathways by thermophilic microorganisms or that such organisms might be isolated from the indigenous microflora of tobacco. Neither do these prior processes suggest that such dissimilatory metabolism could occur in the absence of additives to the fermentation broth or tobacco or under substantially non-aseptic fermentation conditions.

DISCLOSURE OF THE INVENTION

The present invention satisfies all of these criteria. It permits the levels of certain nitrogen-containing compounds in tobacco materials to be reduced by the action of thermophilic microorganisms in high temperature fermentation processes. It permits the levels of nitrates and other nitrogen-containing compounds possibly present in tobacco materials to be reduced via an anaerobic dissimilatory metabolic pathway of thermophilic organisms. And, it permits such reduction to be obtained without the need for additives to the fermentation broth or tobacco materials and without the need for terminal sterilization of the tobacco before fermentation or the need for maintaining substantially aseptic fermentation conditions.

As will be appreciated from the disclosure to follow, the high temperature processes of this invention are characterized by the step of contacting tobacco materials with at least one thermophilic microorganism capable, under the actual fermentation conditions employed, of the anaerobic dissimilation of nitrogen-containing compounds of tobacco, while maintaining the pH and other conditions at levels which promote such anaerobic dissimilatory metabolism. It will be also appreciated from the disclosure to follow that the thermophilic microorganisms of this invention preferably comprise pure or mixed cultures of thermophilic organisms belonging to the indigenous microflora of tobacco or selected mutations thereof.

By virtue of the high temperature processes and thermophilic microorganisms of this invention, the levels of certain nitrogen-containing compounds in tobacco materials may be reduced without the need for additives to the fermentation broth or tobacco materials, without the need for terminal sterilization of the tobacco before fermentation, without the need for maintaining substantially aseptic fermentation conditions and without the need for sparging or treating the fermentation broth with inert gases to remove oxygen. Accordingly, such high temperature processes and thermophilic microorganisms afford the production of smoking products having lowered amounts of oxides of nitrogen, and perhaps other oxides, in smoke without the possible addition of non-tobacco compounds to those products in a commercially effective and economically efficient manner. They also afford the production of other tobacco products having lowered amounts of nitrates and other nitrogen-containing compounds in a similarly effective and economical manner.

DETAILED DESCRIPTION OF THE INVENTION

The present invention provides novel methods and novel microorganisms for reducing the levels of nitrates and other nitrogen-containing compounds in tobacco materials by means of microbial denitrification. The high temperature methods and thermophilic microorganisms of this invention afford the rapid and efficient reduction of the levels of nitrate and other nitrogen-containing compounds in tobacco materials via an anaerobic, dissimilatory, metabolic pathway. This result is accomplished by high temperature processes characterized by the step of contacting tobacco materials with at least one thermophilic microorganism capable of the anaerobic dissimilation of nitrates and other nitrogen-containing compounds in tobacco materials under the actual fermentation conditions employed while maintaining the pH and other conditions at levels which promote such metabolism. Tobacco products prepared from tobacco materials after treatment by such processes and microorganisms have lowered amounts of nitrates and other nitrogen-containing compounds. Moreover, smoking articles prepared from these tobacco materials deliver significantly lowered amounts of oxides of nitrogen, and perhaps other oxides, on smoking.

Broadly stated the processes of this invention comprise the step of contacting tobacco materials with at least one thermophilic organism characterized under the actual fermentation conditions employed by an anaerobic, dissimilatory metabolic pathway for denitrification of tobacco materials under anaerobic and thermophilic conditions that promote such metabolism whereby the level of nitrates and other nitrogen-containing compounds in those tobacco materials is reduced efficiently and economically.

In the practice of the present invention, thermophilic microorganisms which, under the actual fermentation conditions employed, reduce nitrate in tobacco materials to nitrogen gas via a series of metabolic steps commonly known as dissimilatory denitrification are used. Nitrate reduction via this metabolic pathway is believed to be effected by a series of classical enzymatic reactions shown schematically below:

$$NO_3^- \rightarrow NO_2^- \rightarrow NO \rightarrow N_2O \rightarrow N_2 \uparrow$$

Such process is to be contrasted with assimilatory denitrification where nitrate is converted to ammonia and protein or biomass.

For the purpose of the present invention, dissimilatory reduction is selected since nitrogen gas, the end product of the metabolic reduction of nitrate, can be completely and easily removed from the treated tobacco materials. Moreover, no other nitrogen-containing metabolites or other compounds that could potentially affect the subjective characteristics of the treated tobacco materials or influence the characteristics of tobacco products made from those tobacco materials or the smoke produced by smoking products made from those tobacco materials are required by the processes or organisms of this invention.

The processes of this invention are advantaged because no nutrients or supplements must be added to the tobacco materials, the pH of the fermentation is maintained by the action of the microorganism culture itself, the tobacco materials are fed to the microorganism culture at substantially the same temperature as they are contacted with that culture, i.e., substantially no cooling of the fermentation broth is required, i.e. vigorous agitation of the fermentation broth is not required, substantially aseptic fermentation conditions or the terminal sterilization of the tobacco materials prior to contact with the microorganisms is not required because the anaerobic, high temperature conditions of the contact between the tobacco materials and the thermophilic microorganisms discourage the growth of other organisms, and no sparging or other treatment of the fermentation broth is required to remove oxygen.

It should be plainly understood that merely because a thermophilic organism may have a metabolic pathway for the dissimilatory metabolism of nitrate, it cannot be said on that basis alone to be useful in the processes of this invention. This is particularly true for organisms which may in fact have such a metabolic pathway operating under some test or growth media conditions, e.g. a standard biological characterization assay. Rather, to be useful in the high temperature processes of this invention, a thermophilic organism must have operative metabolic pathways that permit the dissimilatory metabolism of nitrate and other nitrogen-containing compounds in tobacco materials under the actual high temperature, anaerobic conditions described herein. Such anaerobic and thermophilic conditions include, for example, a temperature between about 45° C. and about 65° C., and a pH between about 5 and about 10. A wide variety of such thermophilic organisms may be selected by screening for active denitrifiers of tobacco materials under the particular conditions of use described herein. It should be understood that only such latter organisms are included within this invention.

Preferably, the source of such microorganisms is tobacco itself. Although a variety of methods are useful for isolating such microorganisms from tobacco materials, one method employed in this invention was to prepare a portion of extracted tobacco liquor using conventional procedures. The liquor was then diluted with 0.9M NaCl solution and mixed with soft agar (53° C.). The resulting mix was plated on nutrient agar medium and allowed to incubate at 55°–60° C. for 3 days. Colonies that grew well at 55°–60° C. were streaked onto nitrate broth (10 g/l $KNO_3$) agar plates and again incubated at 55°–60° C. Colonies that grew on the nitrate broth were isolated and selected for use in the processes of this invention on the basis of their ability to denitrify tobacco materials under the actual fermentation conditions described herein.

Alternatively, a mixed culture useful in the processes of this invention was prepared by mixing representative samples of extracted tobacco liquor taken, for example, from various locations in an operating reconstituted tobacco processing line. These mixtures were then analyzed for the presence of microorganisms displaying thermophilic denitrification activity by contacting extracted tobacco liquor or nitrate-containing media with the mixture. Colonies that grew in such media were then selected for use in the processes of this invention on the basis of their ability to denitrify tobacco materials under the actual fermentation conditions described herein. It should also be understood that the particular organisms of the mixed culture, displaying such required activity could, of course, be isolated by using the first-described method or even by merely culturing the selected mixture on tobacco extract at 55° C., isolating the various cultures, and selecting those cultures that were active denitrifiers of tobacco materials under the fermentation conditions described herein.

Microorganisms useful in the processes of this invention and identified and isolated by one or more of the above-described methods have been deposited in the American Type Culture Collection, Rockville, Md. on Oct. 1, 1981.

There, they have been assigned the following accession numbers:

Culture PM-1: ATCC 31973
Culture PM-2: ATCC 31974
Culture PM-3: ATCC 31972
Cutlure PM-4: ATCC 31971

Culture PM-1 has been characterized by the American Type Culture Collection as Bacillus sp. Its morphological and biochemical characteristics are set forth below.

Morphological Characterization

Cells are Gram variable, non-motile rods occurring singly and in chains approximately 3.0–4.0 microns×0.7–0.8 microns. Endospores were not initially observed. Subsequent analyses have demonstrated the presence of endospores.

Poor growth was demonstrated on nutrient broth. Nutrient agar growth yielded thin, transparent isolated colonies that are translucent in mass. The colonies are entire, smooth and glistening, slowly becoming opaque.

Biochemical Characterization

Maximum growth temperature=60° C.

Litmus milk—no change.

| Carbohydrate acid production: | Acid | Gas |
|---|---|---|
| Arabinose | + | – |
| Glucose | + | – |
| Lactose | No growth | |
| Mannitol | No growth | |
| Sucrose | + | – |
| Xylose | + | – |
| Growth at pH 6.0 | + | |
| Growth at pH 5.7 | + | |
| Citrate | – | |
| Propionate | – | |
| Azide glucose | + | |
| Egg-yolk reaction | w | |
| Starch hydrolysis | + | |
| Hippurate hydrolysis | – | |
| Gelatin hydrolysis | – (poor growth) | |
| Casein hydrolysis | – (poor growth) | |
| Tyrosine decomposition | – | |
| Catalase | + | |
| Nitrate to nitrite | + | |
| Nitrate to $N_2$ | – | |
| Dihydroxyacetone | – | |
| Indole | – | |
| Voges-Proskauer | – | |
| Methylene blue | No growth | |
| NaCl | | |
| 5% | – | |
| 7% | – | |
| 10% | – | |

Culture PM-2 has been characterized by the American Type Culture Collection as a mixed culture of four apparently different colonies. Two of the colonies are biochemically and morphologically identical to PM-1. The other two colonies are biotypes of *Bacillus licheniformis.* They differ mainly in their aerotolerance. Their morphological and biochemical characteristics are as follows:

Colony 1

Morphological Characterization

Cells are Gram positive, motile rods, occurring singly, approximately 3.0×0.7 microns. Oval endospores were observed.

Good growth was demonstrated on nutrient broth. Nutrient agar growth yielded dull, dry, off white, flat matte, rhizoid spreading colonies. This strain demonstrated anaerobic growth but did not produce gas anaerobically from nitrate broth.

Biochemical Characterization

Maximum growth temperature=55° C.

Litmus milk—neutral, peptonized, reduced at 7–14 days.

| Carbohydrate acid production: | Acid | Gas |
|---|---|---|
| Arabinose | + | – |
| Glucose | + | – |
| Lactose | w | – |
| Mannitol | w | – |
| Sucrose | + | – |
| Xylose | w | – |
| Growth at pH 6.0 | + | |
| Growth at pH 5.7 | + | |
| Growth in Na Azide | – | |
| Citrate | + | |
| Propionate | + | |
| Azide glucose | – | |

-continued

| Carbohydrate acid production: | Acid | Gas |
|---|---|---|
| Egg yolk reaction | – | |
| Starch hydrolysis | + | |
| Hippurate hydrolysis | – | |
| Gelatin hydrolysis | + | |
| Casein hydrolysis | + | |
| Tyrosine decomposition | – | |
| Catalase | + | |
| Nitrate to nitrite | + | |
| Nitrate to $N_2$ | – | |
| Dihydroxyacetone | + | |
| Indole | – | |
| Voges-Proskauer | + | |
| Methylene blue | | |
| reduction | + | |
| reoxidation | – | |
| NaCl | | |
| 5% | + | |
| 7% | + | |
| 10% | + | |

Colony 2

Morphological Characterization

Cells are Gram positive, motile rods, occurring singly and in chains, 3.0×0.8 microns. Oval subterminal and central endospores were observed.

Good growth was demonstrated on nutrient broth, nutrient agar growth yielded dull, dry, flat rhizoid colonies. Some colonies form mucoid and high convex blebs. This strain did not grow anaerobically.

Biochemical Characterization

Maximum growth temperature=55° C.

Litmus milk—alkaline, peptonized, reduced at 7 and 14 days.

| Carbohydrate acid production: | Acid | Gas |
|---|---|---|
| Arabinose | + | – |
| Glucose | + | – |
| Lactose | – | – |
| Mannitol | + | – |
| Sucrose | + | – |
| Xylose | + | – |
| Growth at pH 6.0 | + | |
| Growth at pH 5.7 | + | |
| Citrate | + | |
| Propionate | weak | |
| Growth in Na Azide | – | |
| Azide glucose | – | |
| Egg-yolk reaction | – | |
| Starch hydrolysis | + | |
| Hippurate hydrolysis | – | |
| Gelatin hydrolysis | + | |
| Casein hydrolysis | + | |
| Tyrosine decomposition | – | |
| Catalase | + | |
| Nitrate to nitrite | + | |
| Nitrate to $N_2$ | – | |
| Dihydroxyacetone | + | |
| Indole | – | |
| Voges-Proskauer | + | |
| Methylene blue | | |
| reduction | + | |
| reoxidation | – | |
| NaCl | | |
| 5% | + | |
| 7% | + | |
| 10% | + | |

Culture PM-3 has been characterized by the American Type Culture Collection as *Bacillus licheniformis.* Its morphological and biochemical characteristics are set forth below:

Morphological Characterization

The cells are Gram positive, motile rods, 0.8×3–3.5 microns, occurring singly (rarely in chains) with rounded ends. Endospores are subterminal in location, and are oval to cylindrical in shape. Two colony types are present, one dull, dry, flat and irregular, and one entire smooth and glistening. The colonies are opaque and white in color.

Biochemical Characterization

Maximum growth temperature=55° C.

Litmus milk—+.

| Carbohydrate acid production | Acid | Gas |
|---|---|---|
| Arabinose | + | – |
| Glucose | + | – |
| Lactose | – | – |
| Mannitol | + | – |
| Sucrose | + | – |
| Xylose | + | – |
| Citrate | + | |
| Propionate | + | |
| Gelatin hydrolysis | + | |
| Tyrosine decomposition | – | |
| Growth on nutrient agar - pH 6.0 | + | |
| Dihydroxy acetone | + | |
| Methylene blue | | |
| reduction | + | |
| reoxidation | – | |
| Growth at pH 5.7 | + | |
| Egg yolk reaction | – | |
| Starch hydrolysis | + | |
| Hippurate hydrolysis | – | |
| Casein hydrolysis | + | |
| Catalase | + | |
| Nitrate to nitrite | + | |
| Nitrate to $N_2$ | – | |
| Indole | – | |
| Voges-Proskauer | + | |
| NaCl 5% | + | |
| NaCl 7% | + | |
| NaCl 10% | + | |

Culture PM-4 has been characterized by the American Type Culture Collection as *Bacillus circulans* (asporogenic strain). Its morphological and biochemical characteristics are set forth below:

Morphological Characterization

The cells are Gram positive motile rods, 0.5×3.0 microns, occuring singly with rounded ends. Endospores were not observed. Colonies are smooth, glistening and translucent with central depressions appearing with age.

Biochemical Characterization

Maximum growth temperature=45° C.

Litmus milk—+.

| Carbohydrate Acid production: | Acid | Gas |
|---|---|---|
| Arabinose | – | – |
| Glucose | + | – |
| Lactose | + | – |
| Mannitol | No growth | |
| Sucrose | + | – |
| Xylose | + | – |
| Citrate | – | |
| Egg yolk reaction | – | |
| Starch hydrolysis | – | |
| Propionate | – | |
| Gelatin hydrolysis | – | |
| Tyrosine decomposition | – | |
| Growth on nutrient agar - pH 6.0 | + | |
| Dihydroxyacetone | – | |
| Methylene blue | | |

-continued

| Carbohydrate Acid production: | Acid | Gas |
|---|---|---|
| reduction | No growth | |
| reoxidation | No growth | |
| Growth at pH 5.7 | + | |
| Hippurate hydrolysis | – | |
| Casein hydrolysis | No growth | |
| Catalase | + | |
| Nitrate to nitrate | + | |
| Nitrate to $N_2$ | – | |
| Indole | – | |
| Voges-Proskauer | – | |
| NaCl 5% | – | |
| NaCl 7% | – | |
| NaCl 10% | – | |

Again, it must be emphasized that morphological or biochemical characteristics are not predictive or even suggestive of an organism's ability to denitrify tobacco materials under the fermentation conditions described herein. Instead, these morphological and biochemical characteristics are merely markers based on standard tests and broths to characterize an organism and to distinguish it from other organisms. For example, none of PM-1, any of the four cultures of mixed culture PM-2, PM-3 or PM-4 displays the ability in such standard tests to metabolize nitrate to $N_2$. Yet, under the conditions of the process of this invention PM-1, mixed culture PM-2, PM-3 and PM-4 are useful in the anaerobic dissimilatory denitrification of tobacco materials.

Of course, it should also be understood that this invention is not limited solely to the above-described organisms. Rather, other thermophilic organisms that are characterized by the ability to reduce the level of nitrate and other nitrogen-containing compounds in tobacco materials via anaerobic, dissimilatory metabolism under the conditions described herein are useful in the processes of the invention. Such organisms include both those belonging to the indigenous microflora of tobacco as well as organisms from a variety of other sources, e.g., soil. They also include mutations of those or other organisms that display a similar ability to reduce the levels of nitrate and other nitrogen-containing compounds in tobacco materials via anaerobic, dissimilatory metabolism under the conditions described herein. Such organisms may be isolated, selected and characterized in a similar manner to that described above.

Where microorganisms are capable of a number of metabolic processes it is usually important to subject the microorganisms to an inductive treatment whereby they are better acclimated or conditioned to the anaerobic, dissimilatory metabolism of nitrates in tobacco materials under the conditions described herein before using them in accordance with the processes of this invention. Thus, it may be necessary to subject a selected culture of the thermophilic microorganisms of this invention to an induction process during which a build-up of microorganisms whose enzyme systems are better adapted to such anaerobic, dissimilatory denitrification is obtained. Reference herein to "conditioned microorganisms" is intended to mean microorganisms which are characterized by such operative enzyme systems and which are better acclimated to anaerobic, dissimilatory denitrification of tobacco materials under the conditions described herein.

The induction process can be effected by growth and maintenance of the microorganisms under controlled conditions. For example, a broth containing nitrate-nitrogen, preferably derived from aqueous tobacco extracts, may be inoculated with a culture of the denitrifying thermophilic microorganisms isolated and selected as described above. Normally, the broth should have a nitrate-nitrogen content of at least 10 ppm and more preferably at least about 100 ppm (and preferably no more than 1400 ppm) to support and achieve the desired amount of inoculum build-up. However, concentrations of nitrate-nitrogen of greater than about 10,000 ppm have been employed by cells acclimitized to denitrification of tobacco in the processes of this invention without adverse effects on the thermophilic microorganisms of this invention. It should of course be understood that such high concentrations are not preferred for initial induction. Normally, the inoculted culture should be about 10% and more preferably 10–50% of the volume of the broth.

While additives such as carbon sources, nitrates, phosphates, ammonium salts and metal salts may be employed during induction, it is preferable in the processes of this invention to use extracted tobacco liquor itself without additional additives for induction in order to avoid induction repression regulatory mechanisms which could be operative if induction were had in supplemented media. For example, in such preferred embodiment, an initial culture is prepared by inoculating colonies of one or more thermophilic microorganisms of this invention into a proteinaceous media containing nitrates, e.g., sterile yeast extract, nitrate broth, brain heart infusion, nutrient broth, thioglycollate broth, trypticase soy broth or any other commercially available rich broth. The colonies are then grown at 50° C. to prepare an initial mid-log culture of such microorganisms in accordance with this invention. Extracted tobacco liquor may then be fed continuously to the culture to acclimitize it to the tobacco extract and to prepare the conditioned organisms.

Most preferably, the induction is done as follows. A 10% solution of extracted tobacco liquor (and 90% tap water) is prepared by adjusting the pH of the extracted tobacco liquor (in a 14 l fermenter) to 7.2 by the addition of base, such as NaOH or KOH, this pH is relatively transitory, perhaps because the diluted tobacco liquor is substantially unbuffered. The liquor is then, most preferably, pasteurized at 90° C. for 30 min. After adjusting the temperature of the liquor to 50° C., a mid-log phase culture of at least one thermophilic organism of this invention (~1% of the above-described liquor volume), prepared as described above, was added to the diluted liquor with agitation (50–100 rpm). After the pH of the diluted liquor-1% culture began to increase (about 16 h) extracted tobacco liquor at 60° C. was added to the culture at a rate sufficient to maintain the pH at ~7.2 and the overflow was collected in a second fermenter held at 50° C. After several more hours, about 10 l of overflow had been collected in the second fermenter. This overflow of denitrified extracted tobacco liquor containing the conditioned organisms of this invention may be used as an inoculum for large-scale denitrification processes of this invention.

It should, of course, be understood, that the optimum conditions for preparing an inoculum of thermophilic microorganisms for use in the processes of this invention will depend to some extent on the specific microorganisms employed. For example, in the case of cultures PM-1 through PM-4, the initial pH of the broth should be between 5 and 10 and preferably between 7 and 8.5, the initial temperatures should be between 45° C. and 65° C., with temperatures between 50° C. and 55° C. being preferred, and the broth agitation should be between about 20 and 100 rpm. Similarly, the incubation period required to produce maximum microorganism adaptation to anaerobic, dissimilatory denitrification of tobacco materials will vary according to the relative amounts of nitrate and culture, the induction conditions and the particular microorganisms. However, generally 8–24 h is sufficient.

It is to be understood that the processes of this invention may be employed to denitrify tobacco materials such as whole tobacco leaf, cut or chopped tobacco, reconstituted tobacco, tobacco stems, strips, fines and the like or combinations thereof. As used herein, references to tobacco and tobacco materials are to be understood to include all such forms of tobacco, such as green, cured or stored tobacco. Further it is to be understood that tobacco products, at least a portion of which contain tobacco material that has been denitrified in accordance with the processes of the invention, exhibit a reduced level of nitrates and other nitrogen-containing compounds as compared to products prepared using wholly untreated tobacco material. Such tobacco products may include products consumed by smoking or by other means, e.g., chewing tobacco, snuff and the like. Moreover, when such tobacco products are consumed by combustion, they display reduced nitrogen oxide delivery, and perhaps reduced oxide delivery in general. Such latter smoking products include, for example, cigars, cigarettes, cigarellos and the like.

In accordance with the processes of this invention, such tobacco materials may be contacted with the thermophilic microorganisms of this invention in any of the conventional ways. For example, in the case of aqueous tobacco extracts, continuous, batch and fed-batch processes may be used to good effect. And, in the case of solid tobacco materials, conventional methods of fermentation, sweating and curing are useful.

In the practice of the present invention the tobacco materials for contact with the organisms of this invention are produced by employing conventional techniques. For example, tobacco materials may be contacted with an aqueous solution to extract the soluble components, including nitrate salts. The time of contact will depend on the water to tobacco ratio and the temperature of the aqueous solution. The aqueous extract produced by contact with the water solution is then separated from the insoluble fibrous tobacco residue, employing conventional solid-liquid separation techniques. For example, squeezing, centrifugation and filtration techniques may be employed. If necessary the separated tobacco extract may then be treated to adjust the soluble solids and/or nitrate content. However, generally extracts containing up to about 21% soluble solids and up to about 10,000 ppm nitrate-nitrogen may be treated in accordance with this invention.

It should, of course, be understood that other methods of preparing tobacco materials for contact with the microorganisms of this invention may also be employed. These include, for example, suspending tobacco materials in water to form a slurry having a concentration of about 5% to about 40% solids, and more preferably from about 5% to 20% solids, before contacting them in the processes of this invention. Alternatively, in the case of solid tobacco materials, the tobacco may be prepared using conventional spraying techniques to provide a water content sufficient to permit growth of the organisms of this invention.

Terminal sterilization of the tobacco materials prior to commencing the processes of this invention or operating under substantially aseptic conditions is generally not necessary in the processes of this invention. In fact, it is an advantage of the processes and organisms of this invention that substantially nonaseptic conditions may be employed, e.g., no terminal sterilization of the tobacco materials and the use of open tanks for fermentation. However, in continuous flow systems, a steadier flow rate can be maintained if the aqueous tobacco extracts are first pasteurized for 30 min at 90° C. (a non-terminal sterilization). This treatment reduces the contaminant cell population from about $10^8$ cells/ml to about $10^3$–$10^4$ cells/ml.

Application of a vacuum during fermentation involving dissimilatory denitrification has been shown to improve the rate of denitrification in some cases. This is believed to be due, at least in part, to a more rapid diffusion of the nitrogen gas end products and their removal from the system as a result of application of the vacuum. Therefore, during practice of the processes of this invention a vacuum may be usefully maintained in the fermentation vessel.

Any conventional means for producing a vacuum may be employed. The degree of vacuum utilized during fermentation depends in part on the growth kinetics of the microorganisms involved and the organism's ability to produce the sequential enzyme systems required for the metabolic denitrification process under negative pressure. For example, at sufficiently high vacuum levels microbial functions may be adversely affected. The exact level at which this occurs for a given microorganism can be experimentally determined by the exercise of ordinary skill in the art. In addition, the viscosity of the tobacco material being denitrified and the potential fluid "boil over" effect that may occur at higher vacuums also limit the degree of vacuum which can be applied to the system. Generally, a vacuum in the range up to about 500 mm Hg has been found to facilitate denitrification without adversely affecting the microorganisms. With a solution of low viscosity, the pressure should generally be maintained in the range of about 50 mm Hg to about 200 mm Hg, whereas solutions of higher viscosity, for example, about 500 centipoises or greater, will permit a vacuum in the range of about 150 mm Hg to about 500 mm Hg.

Although the cell concentration of the inoculum for denitrification of tobacco materials and the relative volume of that inoculum is to some extent a matter of judgment, it is preferable in the processes of this invention to use inoculums having about $10^6$–$10^8$ cells/ml and having a volume of about 10–50% of that of the tobacco materials, the relative volume depending on a balance of economy and efficiency.

As with the preparation of the inoculum, the optimum conditions of the fermentation of tobacco materials will depend on the specific microorganism employed, the amount of nitrogen-containing compounds in the tobacco material, the concentration of cells in the inoculum, the relative volume of inoculum and the type of tobacco material to be treated. For cultures PM-1 through PM-4, effective denitrification is achieved at temperatures between 45° C. to 65° C., preferably 50° C. to 55° C., at pH's between 5 to 10, preferably 7.0 to 8.5, and at least in aqueous tobacco liquors with agitation by means of, for example, conventional bottom propellers or multiple impeller arrangements, of about 20–100 rpm.

The rate of feed of aqueous tobacco extracts to the inoculum also depends on the specific microorganism employed, the cell mass and cell number, the nitrate concentration of the extract and the other fermentation conditions. However, for cultures PM-1 through PM-4 it is preferable in continuous processes to feed aqueous tobacco extracts, preferably at 48°–50° C., and having up to about 21% solids and up to about 10,000 ppm nitrate-nitrogen content, slowly $$\left(\text{dilution rate} = \frac{\text{flow rate}}{\text{liquid volume}} \approx 0.1\ \text{h}^{-1}\right)$$

to the inoculum. Of course, it should be understood that the dilution rate depends to some extent on the nitrate concentration. For example at 9000 ppm $NO_3$—N, a dilution rate of about 0.04 $hr^{-1}$ was found to be effective.

Alternatively, the pH of the fermenter charge can be monitored and the flow rate adjusted to maintain the pH between about 5 and 10 and more preferably between about 7.0 and 8.5. These rates permit removal of similar amounts of substantially denitrified extract beginning from the time the fermenter is full. For fed-batch processes, of course, faster rates may be used. Preferably, the rate of addition in those processes is determined by monitoring the the pH of the fermenter charge and adjusting the flow rate to maintain the pH between about 5 and 10 and more preferably between about 7 and 8.5. Alternatively, the feed rate could be controlled by monitoring the nitrate content of the fermenter charge. Upon completion of the feed, the conditions of the fermenter should be maintained for a short time to ensure substantially complete denitrification; the time depending on the feed rate, the cell mass and volume of the culture, the nitrate concentration and the specific organism employed.

During denitrification, the dissolved oxygen content of the fermentation charge should be low enough for anaerobic dissimilatory reduction of nitrate to nitrogen gas to occur. Typically, dissolved oxygen levels below 0.5 ppm are adequate. However, optimally, levels as close to zero as possible may be more desirable in order to expedite dissimilatory denitrification. Although the initial oxygen content of the fermentation charge may be above zero, the content will rapidly be reduced by the microorganisms of this invention themselves, such that desirable low levels are achieved within the early part of the incubation stage. Typically, such oxygen content reduction will be complete within 30 minutes after fermentation commences. During operation of the processes of this invention, near zero oxygen levels can be maintained by a similar mechanism. Sparging with an inert gas, such as nitrogen or helium, for 10 min at a flow rate equal to the volume to be deaerated is generally effective to reach about 0 ppm dissolved oxygen. However, it is an advantage of the processes of this invention that sparging is not required and is generally not employed during operation of the processes of this invention.

Following denitrification, the aqueous tobacco extracts treated in accordance with this invention may, for example, be combined with water insoluble or other tobacco materials which have been for example made into a sheet using conventional tobacco reconstitution methods. Prior to such reconstitution the treated tobacco materials may be concentrated if necessary or desired. The resulting reconstituted tobacco may then be employed in various smoking products. Any such smoking product will exhibit reduced delivery of nitrogen oxides, and perhaps reduced delivery of other oxides in general, during combustion.

For the treatment of solid tobacco materials by the processes and organisms of this invention, the organisms employed may be added to the tobacco material by spraying an inoculum onto it or the organisms already present on the solid tobacco material itself may be employed. In either case, the tobacco material must be wet enough to support growth of the organism; such necessary water content being conventionally determined by exercise of ordinary skill in the art. In addition, the pH and other characteristics of the tobacco materials may be adjusted before or during treatment. Finally, a carbon source may be added to increase the rate of denitrification of those solid tobacco materials that are low in reducing sugars, e.g., Burley tobacco stems.

The following examples are illustrative of the invention:

EXAMPLE 1

This Example demonstrates the use of the processes and microorganisms of this invention in the denitrification of aqueous tobacco extracts.

An aqueous tobacco extract was prepared by extracting a Burley tobacco blend with water, employing a 10:1 water to tobacco ratio at 90° C. for 60 min. The extract thus formed was separated from the insoluble tobacco residue by conventional techniques. If necessary, the percent solids and nitrate-nitrogen concentration of the extract were adjusted to desired levels by conventional means such as dilution or evaporation. The tobacco extract contained about 7.5% soluble solids and about 4000 ppm nitrate-nitrogen and had a pH of 5.5.

37.85 liters of this extracted tobacco liquor were charged into a 500 l fermenter and its pH adjusted to 7.2 with KOH. The liquor was then diluted to 10% concentration by the addition of 341 l tap water and the diluted liquor pasteurized at 90° C. for 1½ h. The liquor was then cooled to 50° C. and 4 l of a mid-log phase culture of PM-1 added (1% of liquor volume) with slight agitation (about 50 rpm). The latter culture had been prepared by inoculating into sterile trypticase soy broth (containing 1 g/l potassium nitrate), dispersed in a shaker flask, a mid-log culture of PM-1 that had been stored on a stab of trypticase soy agar and shaking the inoculated broth for 12 h at 50° C.

After inoculation, agitation of the fermenter charge was continued, its temperature maintained at 50° C. and its pH continuously monitored. After about 24–36 h, the pH began to increase. From that point on the pH was maintained at about 7.2 by the addition of extracted tobacco liquor (4000 ppm N—$NO_3$, pH 5.5), prepared as above and pasteurized at 90° C. for ½ h. After fermentation at about pH 7.2 and 50° C. for 2–3 days, extracted tobacco liquor, prepared as above and pasteurized at 90° C. for ½ h, was fed to the fermenter at a dilution rate of about 0.1 $h^{-1}$, the overflow being collected in a holding tank.

When about 100 gal of this overflow had been collected, it was dumped into a 500-gallon tank maintained at 50° C. with agitation and extracted tobacco liquor, prepared as above and pasteurized at 90° C. for ½ h, was fed into the tank at 50° C. at a rate of 0.5 gal/min. When the tank was full, the contained extracted tobacco liquor that had been denitrified by the processes and microorganisms of this invention displayed N—$NO_3$ and N—$NO_2$ contents of 0 ppm (via standard colorimetric analyses). At this time 50% of the 500 gal tank was employed for making smoking products. The above procedure of adding tobacco extract at a flow rate of 0.5 gal/min until the tank was full then dumping 50% of the tank was repeated numerous times over several weeks with substantially the same results.

One batch of tobacco liquor denitrified as above was further employed to make smoking products. The denitrified liquor was handled using conventional techniques and applied to a sheet of fibrous residue from a blend of tobacco materials to provide reconstituted tobacco. A portion of that reconstituted tobacco was then combined with a conventional blend of tobacco materials and smoking products were prepared and analyzed in standard smoking tests. The results of those tests are displayed in Table I.

Additional runs were also made using the mixed culture designated PM-2 in which tobacco extracts having 4000 and 2000 ppm $NO_3$—N respectively were denitrified. Reconstituted tobacco sheet was prepared and mixed with a typical tobacco blend. Cigarettes were made with the blends and smoked analytically. The results are also displayed in Table I. The control samples containing reconstituted tobacco prepared according to U.S. Pat. No. 4,131,117 were smoked analytically for comparative purposes. In each instance, the reconstituted tobacco comprised 20% or 27% of the total blend. All cigarettes smoked had the same conventional filters attached thereto.

TABLE I

| | FTC TAR | TPM | Nicotine | Puff Count | CO | NO | RCHO | HCN |
|---|---|---|---|---|---|---|---|---|
| Control - 20% | 16.2 | 20.5 | 1.14 | 9.8 | 13.6 | 0.24 | 0.82 | 0.14 |
| Control - 27% | 14.9 | 18.9 | 1.08 | 9.4 | 14.0 | 0.25 | 0.88 | 0.13 |
| PM-1[a] 20% | 14.6 | 18.2 | 1.08 | 10.7 | 10.5 | 0.17 | — | — |
| PM-1[a] 27% | 14.3 | 17.6 | 1.06 | 11.2 | 12.0 | 0.18 | — | — |
| PM-2[a] 20% | 14.0 | 17.5 | 1.00 | 10.3 | 11.5 | 0.18 | 0.79 | 0.10 |
| PM-2[a] 27% | 12.0 | 15.9 | 0.97 | 9.9 | 10.8 | 0.15 | 0.81 | 0.08 |
| PM-2[b] 20% | 16.3 | 20.5 | 1.18 | 10.3 | 13.1 | 0.20 | 0.89 | 0.13 |
| PM-2[b] 27% | 14.2 | 18.0 | 1.10 | 9.6 | 13.1 | 0.16 | 0.88 | 0.12 |

[a]Tobacco extract starting with 4000 ppm $NO_3$—N;
[b]Tobacco extract starting with 2000 ppm $NO_3$—N;

From the above data it is plain that the processes and organisms of this invention, particularly the preferred organism PM-1, are useful in reducing the levels of nitrogen-containing compounds and probably other oxides like CO in tobacco materials. These reductions are even more pronounced when the levels of such compounds per puff are compared.

EXAMPLE 2

This Example demonstrates one embodiment in accordance with this invention of preparing and selecting mutants of the thermophilic organisms of this invention and of using those mutants in the denitrification of tobacco materials in the processes of this invention.

A 14 l fermenter (Fermenter #1) was charged with 10 l trypticase soy broth supplemented with 10 g/l $KNO_3$ (pH 7.8). The charge was sterilized and the temperature adjusted to 55° C. and 100 rpm of agitation supplied.

Extracted tobacco liquor (pH 5.96, 1444 ppm $NO_3$—N), prepared as described above, was adjusted to pH 7.0, heated to 60° C. and maintained at that temperature. It was then fed at a rate of 5 ml/min to Fermenter #1. This feed was maintained for 24 h, the overflow being collected and stored at 55° C.

One hundred ml of the overflow from Fermenter #1 was then mixed with 500 ml of sterile trypticase soy broth in a 1000 ml flask and 5 mg nitrosoguanidine (a mutagenesis agent) were added and the mixture allowed to stand at 55° C. for 4 h without shaking. One gram $KNO_2$ was then added and the mixture combined with 10 l sterile trypticase soy broth supplemented with 10 g $KNO_2$ in a 14 l fermenter (Fermenter #2).

After 4 h the contents of Fermenter #2 were fed at a rate of 15 ml/min into another fermenter (Fermenter #3) maintained at 55° C. Simultaneously, extracted tobacco liquor as described above and whose pH had been adjusted to 7.0, was also fed at 20 ml/min into Fermenter #3. These combined feeds were continued for 24 h. However, every 6 h another mutagenized culture was prepared, as described above, and after mixture with 10 l trypticase soy broth and supplementation with 10 g $KNO_2$ that culture was added to Fermenter #2. The overflow from Fermenter #3 was collected and maintained at 55° C.

After 24 h the feeds to Fermenter #3, now containing a mixed culture of mutagenized organisms that grow well in extracted tobacco liquor under anaerobic, thermophilic conditions, were adjusted. Now, 50 ml/min of extracted tobacco liquor (pH 5.96, 1444 ppm $NO_3$—N) were added to Fermenter #3 and 15 ml/min of the overflow from Fermenter #3 were recycled back to Fermenter #3. The following data were obtained:

| | Initial Measurement | | |
|---|---|---|---|
| | Liquor Feed | Fermenter #3 | Overflow from Fermenter #3 |
| pH | 5.96 | 7.96 | 7.71 |
| $NO_3$—N (ppm) | 1444 | 0 | 0 |
| $NO_2$—N (ppm) | 0 | 0 | 0 |
| $NH_3$ (ppm) | 507 | 2210 | 1831 |
| | | 3 h | |
| pH | 5.36 | 7.9 | 7.7 |
| $NO_3$—N (ppm) | 1507 | 0 | 0 |
| $NO_2$—N (ppm) | 0 | 0 | 0 |
| $NH_3$ (ppm) | — | — | — |
| | | 21 h | |
| pH | 5.1 | 7.4 | 7.2 |
| $NO_3$—N (ppm) | 1587 | 0 | 0 |
| $NO_2$—N (ppm) | 0 | 0 | 63 |
| $NH_3$ (ppm) | 510 | 1448 | 1372 |
| | | 25 h | |
| pH | 5.1 | 7.4 | 7.2 |
| $NO_3$—N (ppm) | 1587 | 0 | 0 |
| $NO_2$—N (ppm) | 0 | 0 | 0 |
| $NH_3$ (ppm) | 510 | 1448 | 1372 |
| | | 28 h | |
| pH | 5.25 | 7.66 | 7.48 |
| $NO_3$—N (ppm) | 1700 | 0 | 0 |
| $NO_2$—N (ppm) | 0 | 0 | 0 |
| $NH_3$ (ppm) | 600 | 1576 | 308 |

EXAMPLE 3

This Example demonstrates the use of the processes and microorganisms of this invention in the denitrification of solid tobacco materials.

One kilogram of unsterilized Burley tobacco stems containing 1.99% $NO_3$—N were prepared in a conventional manner and sprayed with 400 ml $H_2O$ at room temperature. After standing for 2 h, the tobacco was again sprayed with 400 ml $H_2O$ and after standing another 2 h sprayed with a final 771 ml $H_2O$ at room temperature. The sprayed tobacco stems were then incubated at 50° C. for 72 h. The resultant stems now had a reduced level of nitrate—1.51%. $NO_3$—N. Repeating the above process with 5% glucose solution instead of water afforded a tobacco material having a nitrate level of 1.40% $NO_3$—N. This suggests that a carbon source, while not required in the treatment of solid Burley tobacco stems (which are low in reducing sugars) in the processes of this invention, may be usefully employed to increase the rate of denitrification in those tobacco stems.

In a similar process to that described above, except that after 12 days of incubation the tobacco material was sprayed with 100 ml of a 1% glucose solution and then incubated for 2 more days, 500 g Burley tobacco stems were treated by the processes of this invention. The following results were observed:

| Time | $NO_3$—N (%) |
|---|---|
| 0 h | 2.32 |
| 72 h | 1.90 |
| 12 days | 1.70 |
| 14 days | 1.56 |

While we have hereinbefore presented a number of embodiments of this invention, it is apparent that our basic construction can be altered to provide other embodiments which utilize the process of this invention. Therefore, it will be appreciated that the scope of this invention is to be defined by the claims appended hereto rather than the specific embodiments which have been presented hereinbefore by way of example.

We claim:

1. A process for the denitrification of tobacco materials, comprising the step of contacting said tobacco materials, which have not been terminally sterilized, with at least one thermophilic organism characterized by an anaerobic, dissimilatory, metabolic pathway for denitrification of tobacco materials under anaerobic and high temperature conditions, of above about 45° C., that promote such metabolism, wherein said temperature is maintained without cooling.

2. The process according to claim 1, wherein said tobacco materials are selected from the group consisting of whole tobacco leaf, cut or chopped tobacco, reconstituted tobacco, tobacco stems, shreds, fines and combinations thereof.

3. The process according to claim 1 or 2, wherein said tobacco materials are first extracted with water to produce an aqueous tobacco extract having a nitrate-nitrogen content of from about 10 ppm to more than about 10,000 ppm and said extract is then contacted with said organisms.

4. The process according to claim 1 or 2, wherein said tobacco materials are first suspended in water to form a slurry having a concentration of about 5% to about 40% solids by weight and said slurry is then contacted with said organisms.

5. The process according to claim 4, wherein said tobacco materials are first suspended in water to form a slurry having a concentration of about 5% to about 20% solids by weight and said slurry is then contacted with said organisms.

6. The process according to claim 1 or 2 wherein said tobacco materials are first sprayed with water to form a tobacco having sufficient water for growth of said organisms and said tobacco is then contacted with said organisms.

7. The process according to claim 6 wherein said water also contains from about 1% to about 5% of a carbon source.

8. The process according to claim 1, wherein said anaerobic and thermophilic conditions include a temperature of between about 45° C. and about 65° C.

9. The process according to claim 1, wherein said anaerobic and thermophilic conditions include a pH of between about 5 and about 10.

10. The process according to claim 9, wherein said pH is between about 7 and about 8.5.

11. The process of claim 1, wherein said thermophilic organisms are selected from the group consisting of thermophilic organisms belonging to the usual microflora of tobacco materials, thermophilic organisms from other sources, mutations of such organisms and combinations thereof, all such organisms being characterized by an anaerobic, dissimilatory, metabolic pathway for denitrification of tobacco materials under anaerobic and high temperature conditions that promote such metabolism.

12. The process of claim 11, wherein said thermophilic organsism are selected from the group consisting of PM-1, PM-2, PM-3, PM-4, biotypes of Bacillus circulans and Bacillus licheniformis, mutations of such organisms and combinations thereof, all such organisms being characterized by the anaerobic, dissimilatory, metabolic pathway for denitrification of tobacco materials under anaerobic and high temperature conditions that promote such metabolism.

* * * * *